US006523490B1

(12) United States Patent
Watkins

(10) Patent No.: US 6,523,490 B1
(45) Date of Patent: Feb. 25, 2003

(54) ADJUSTABLE SPONSON FOR WATERCRAFT

(75) Inventor: Scott J. Watkins, Huntington Beach, CA (US)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 08/877,960

(22) Filed: Mar. 17, 1997

Related U.S. Application Data

(63) Continuation of application No. 08/586,144, filed on Jan. 17, 1996, now abandoned.

(51) Int. Cl.[7] ..... B63B 35/73

(52) U.S. Cl. ..... 114/55.54; 114/55.5; 114/284

(58) Field of Search ..... 114/270, 271, 114/280, 284, 283, 292, 55.5, 55.54, 55.56

(56) References Cited

U.S. PATENT DOCUMENTS

| | | | | |
|---|---|---|---|---|
| 1,075,726 A | | 10/1913 | Prosser | 114/283 |
| 2,832,304 A | | 8/1955 | Elyosius et al. | |
| 2,919,669 A | | 1/1960 | Kikuhara | |
| 3,106,178 A | | 10/1963 | Cale | |
| 3,115,860 A | * | 12/1963 | Payne | 114/123 |
| 3,159,131 A | | 12/1964 | Frederick | 114/285 |
| 3,481,297 A | | 12/1969 | Mantle | |
| 4,260,180 A | | 4/1981 | Halushka et al. | |
| 4,320,713 A | | 3/1982 | Nishida et al. | 114/123 |
| 4,458,622 A | | 7/1984 | Anderson | 114/284 |
| 4,679,959 A | | 7/1987 | Cavallaro | |
| 4,909,176 A | | 3/1990 | Kobayashi | 114/343 |
| 5,313,907 A | | 5/1994 | Hodges | 114/290 |

FOREIGN PATENT DOCUMENTS

| | | | | |
|---|---|---|---|---|
| DE | 357644 | * | 6/1921 | 114/126 |
| FR | 2574747 | * | 6/1986 | 114/271 |
| JP | 62-157694 | | 10/1987 | |
| JP | 5238476 | | 9/1993 | |
| JP | 6191466 | * | 7/1994 | 114/271 |

OTHER PUBLICATIONS

Advertisement from Bert's Watercraft Mall for Aero–Slot Sponsons (publication and date unknown).
Advertisement for Twist Watercraft Sponsons from MSD Ignition/Twist Engine, Inc. *Splash*, pg. 68, vol. 8. No. 5 (May, 1995).
Advertisement for three new sponsons from MSD Ignition/Twist Engine, Inc. *Watercraft World*, pg. 89 (Jul. 1995).
Advertisement for sponsons from MSD Ignition/Twist Engine, Inc. *Personal Watercraft Illustrated*, pg. 35, vol. 9, No. 8 (Aug. 1995).
Advertisement for Pro Series Sponson from MSD Ignition/Twist Engine, Inc. *Watercraft World*, p. 66 (Nov./Dec. 1995).
Article on sponson "Getting a Handle "from *Personal Watercraft Illustrated*, p. 68 (Jan. 1995).
Kawasaki JS550–A1 Jet Ski Watercraft Parts Catalog. 1982 Kawasaki Motors Corp., U. S. A., Apr. 1962.

* cited by examiner

*Primary Examiner*—Jesus D. Sotelo
(74) *Attorney, Agent, or Firm*—Knobbe, Martens, Olson & Bear, LLP

(57) ABSTRACT

An adjustable sponson for a personal watercraft allows the vertical position and the angular orientation of the sponson to be adjusted to suit the particular size and riding style of each rider. Each adjustable sponson includes a sponson body. At least one locking mechanism releasably attaches the sponson body to the hull side. A guide mechanism allows the sponson body to move vertically relative to an outer chine of the watercraft hull when the locking mechanism is loose. The guide mechanism also permits the ends of the sponson body to move independent of each other so that the angular orientation of the sponson body relative to the chine can be altered. When locked, the locking mechanism prevents movement of the sponson body over the hull side surface.

24 Claims, 6 Drawing Sheets

ADJUSTABLE SPONSON FOR WATERCRAFT

This application is a continuation of U.S. patent application Ser. No. 08/586,144, filed Jan. 17, 1996, now abandoned.

BACKGROUND OF THE INVENTION

1. Field of the Invention

The present invention relates in general to watercrafts. In particular, the present invention relates to an improved sponson design for a watercraft.

2. Description of Related Art

Personal watercrafts have become very popular in recent years. An enthusiasm for competition has grow with this popularity, and as a result personal watercrafts have become increasingly faster. Many personal watercrafts today are capable of traveling at speeds above 60 mph. At such speeds, however, such watercrafts (especially those with modified engines) tend not to provide the stability that many riders prefer. High performance personal watercrafts also tend not to respond in a manner which many riders desire.

To improve the stability and the handling characteristics of the watercraft at high speeds, many personal watercrafts now include sponsons. A sponson is an elongated rib attached to the hull side of the personal watercraft. The sponson typically includes a downwardly projecting outer edge. Personal watercraft generally include a pair of sponsons which are positioned on opposite sides of the watercraft at the same position and in the same angular orientation relative to the outer chines of the watercraft hull. Some sponsons are integrally formed with the hull when the watercraft hull is molded. Other sponsons are fixed to the hull in a set position and angular orientation relative to the hull outer chines by conventional fasteners (e.g., screws).

Sponsons give a personal watercraft greater stability by creating greater hull surface area when the watercraft is up on plane. The effective hull surface at high speeds offers greater stability and gives the rider the feeling that the personal watercraft is wider than its actually width.

The sponsons also improve the handling characteristics of the personal watercraft. The sponsons counteract the rider's shifted weight when turning, thereby allowing the rider to lean into a turn. By positioning the sponsons at points on the hull sides which lie below the water line when the watercraft is turning, the turning or handling characteristics of the watercraft also become more aggressive; i.e., a low position of the sponsons on the hull sides makes the watercraft more responsive.

SUMMARY OF THE INVENTION

The present invention includes the recognition that the optimum placement of the sponsons on a personal watercraft varies with the rider's size, the rider's riding style, the number of riders and riding conditions (i.e., water roughness). No perfect placement of the sponsons on the watercraft exists to maximize the stability and handling characteristics of the watercraft for every rider and under every riding condition. Previous sponson placement has been selected to produce a particular riding style, which of course does not suit every rider of the watercraft.

This problem is compounded when the watercraft is used by both single and multiple riders (e.g., three riders). varying number of riders gives rise to different loadings of the watercraft in a fore and aft direction, and the ideal position of the sponsons of course changes depending upon the number of riders.

It therefore is appreciated that a need exists for an adjustable sponson which can be easily and readily adjusted to tailor the responsiveness and stability of the watercraft depending upon the size and riding style of the rider and depending upon the number of riders.

It also is understood that the shape and the length of the sponsons affect the handling characteristics and the stability of the watercraft. A need therefore also exists to quickly and easily substitute styles and sizes of sponsons depending upon the rider's size and style, the particular number of riders, the size and shape of the watercraft, and the desired handling character of the watercraft.

An aspect of the present invention thus involves an adjustable sponson adapted for use with a watercraft. The adjustable sponson comprises an elongated sponson body with a guide mechanism that is operable between the sponson body and the watercraft hull. The guide mechanism defines a travel path for at least a portion of the sponson body over an outer surface of the watercraft hull. A locking device establishes a set position of the portion of the sponson body along the travel path.

In accordance with another aspect of the present invention, an adjustable sponson for attachment to a hull of a watercraft comprises a sponson body having an elongated, rib-like shape. Means are provided for adjusting the position of the sponson body on the hull of the watercraft. The adjustable sponson also includes means for setting the position of the sponson body on the hull.

An additional aspect of the present invention involves an adjustable sponson comprising a sponson body which is attached to the hull by a coupling mechanism. The coupling mechanism has at least first and second operational states. The coupling mechanism permits at least a portion of the sponson body to move relative to the watercraft hull when in the first operational state. And the coupling mechanism establishes a set position of the sponson body on the watercraft hull when in the second operational state.

BRIEF DESCRIPTION OF THE DRAWINGS

These and other features of the invention will now be described with reference to the drawings of preferred embodiments of the present invention which are intended to illustrate and not to limit the invention, and in which.

DETAILED DESCRIPTION OF PREFERRED EMBODIMENTS

Figure 1:
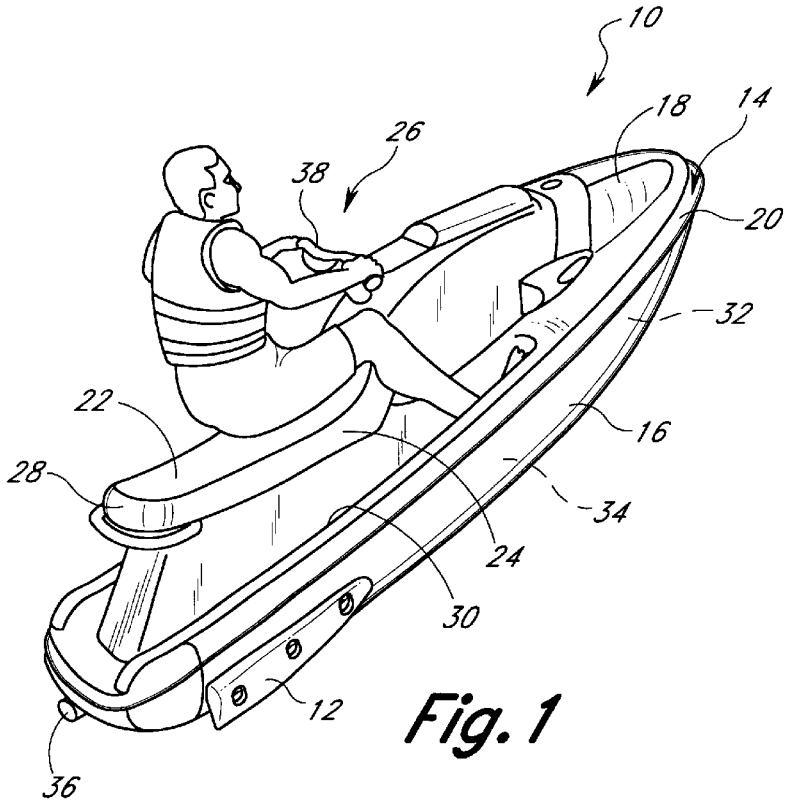
FIG. 1 is a starboard side perspective view of an exemplary watercraft which includes adjustable sponsons configured in accordance with a preferred embodiment of the present invention.

FIG. 1 illustrates a personal watercraft 10 which includes a pair of adjustable sponsons 12 configured in accordance with a preferred embodiment of the present invention. Although the present adjustable sponson 12 is illustrated in connection with a personal watercraft, the adjustable sponson 12 can be used with other types of watercraft, such as, for example, but without limitation, small jet boats and the like.

Before describing the adjustable sponson 12 in detail, an exemplary personal watercraft 10 will first be described in general details to assist the reader's understanding of the environment of use and the operation of the adjustable sponson 12. As understood from FIG. 1, the watercraft 10 includes a hull 14 formed by a lower hull section 16 and an upper deck section 18. The hull sections 16, 18 are formed from a suitable material, such as, for example, a molded fiberglass reinforced resin. The lower hull section 16 and the upper deck section 18 are fixed to each other around their peripheral edges 20 in any suitable manner.

A passenger seat 22 is provided proximate the stern of the hull 14. The passenger seat 22 is mounted longitudinally along the center of the watercraft 10. In the illustrated embodiment, the seat 22 has a longitudinally extended straddle-type shape, which may be straddled by an operator and by at least one or two passengers. A forward end 24 of the seat 22 lies proximate to the controls 26 of the watercraft, which generally lie at about the longitudinal center of the watercraft 10. This position of the rider gives the watercraft fore and aft balance when the operator rides alone. A rear portion 28 of the seat 22 is configured to allow one or two passengers to be comfortably seated behind the operator of the watercraft 10. The seat 22 desirably includes a seat cushion to increase the comfort of the operator and the passengers.

The upper deck section 18 of the hull 14 advantageously includes foot areas 30. The foot areas 30 extend generally longitudinally and parallel to the sides of the elongated seat 22 so that the operator and any passengers sitting on the seat 22 can place their feet in the foot areas 30. A non-slip surface (not shown) is located in the foot areas 30 to provide increased grip and traction for the operator and the passengers.

The lower hull section 16 of the personal watercraft 10 includes a forward compartment 32 and a rear compartment 34. In the exemplary watercraft depicted in FIG. 1, a fuel tank and a buoyant block (not illustrated) commonly are located in the forward compartment 32. The buoyant block affords additional buoyancy to the watercraft 10. An internal combustion engine (not shown) used to power the watercraft 10 conventionally lies in the rear compartment 34, beneath the front end 24 of the seat 22. A battery can be positioned proximate the engine to provide a source of electrical power for accessories of the watercraft 10 and for starting the engine. The cushion of the seat 22 desirably can be removed to provide access to the engine and battery.

The engine drives a jet propulsion unit (not shown) to propel the watercraft 10. The jet propulsion unit is positioned in a tunnel (not shown) in the rear center of the lower hull section 16 and has a downwardly facing water inlet port through which water is drawn from the body of water in which the watercraft 10 is operated. The engine output shaft drives an impeller located within the tunnel. If the engine output shaft is vertically disposed, the impeller will be driven through a bevel gear transmission or similar transmission.

The water, which is pressurized within the tunnel by the impeller, is discharged through a steering nozzle 36. The steering nozzle 36 is pivotally supported at the rear of the jet propulsion unit to change the thrust angle on the watercraft 10 for steering purposes, as known in the art.

The steering nozzle 36 is connected to a steering handle 38. The steering handle 38 forms part of the operator controls 26 which are mounted in front of the operator's seat 24, as noted above. The steering handle 38 also can include a throttle control for controlling the speed of the engine.

Figure 2:
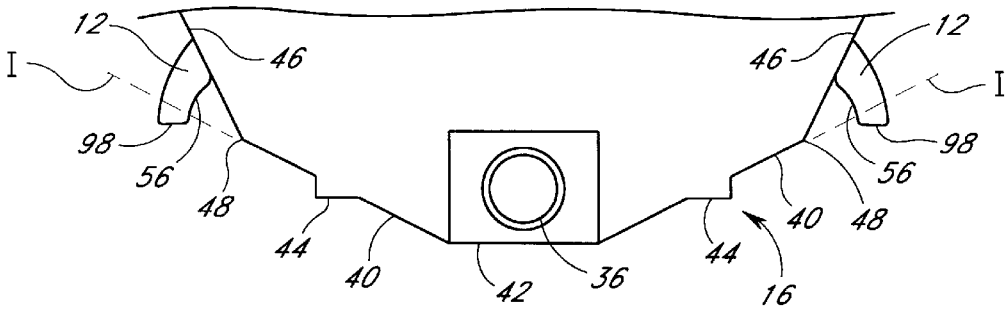
FIG. 2 is a partial rear elevational view of the watercraft of FIG. 1.

As best understood from FIG. 2, the lower hull section 16 generally has a V-bottom formed by a pair of angularly disposed surfaces 40 which extend outwardly from a generally flat center section 42 of the lower hull section 18. Each angularly disposed surface 40 of the lower hull section 18 can include one or more inner chines 44, as known in the art.

The center section 42 includes the water inlet port (not shown) for the jet propulsion unit. The inlet is located proximate the rear of the watercraft 10 and communicates with the tunnel of the jet propulsion unit.

The angularly disposed surfaces 40 terminate at longitudinally extending side walls 46. The sides 46 are inclined more steeply than the angularly disposed surfaces 40. As understood FIG. 1, the sides 46 are generally flat and straight near the stern of the watercraft hull 14 and smoothly bend toward the longitudinal center of the watercraft 10 toward the bow. The lines of intersection between the angularly disposed surface 40 and the corresponding side walls 46 form the outer chines 48 of the lower hull section 16.

The personal watercraft 10 so far described is conventional and represents only an exemplary watercraft on which the present adjustable sponsons 12 can be employed. A further description of the personal watercraft 10 therefore is not believed necessary for an understanding and an appreciation of the present adjustable sponsons 12. The adjustable sponsons 12 will now be described in detail.

In the illustrated embodiment of FIGS. 1 and 2, the personal watercraft 10 includes a pair of adjustable sponsons 12, although the watercraft 10 can include any number of adjustable sponsons 12 in order to suit a particular application or loading condition. As understood from FIGS. 1 and 2, a starboard side sponson 12 attaches to the starboard side 46 of the lower hull section 16 and a port side sponson 12 attaches to the port side 46 of the lower hull section 16. Each sponson 12 is attached above the outer chine 48 on the corresponding side of the lower hull section 16 of the watercraft 10. The sponsons 12 are positioned proximate the stern of the watercraft 10 and extend outwardly for increased buoyancy and stability, as described below. The positions and angular orientations of the sponsons 12 relative to the outer chines 48 desirably are the same for both sponsons; however, the sponsons 12 can be set at different positions and angular orientations to give the watercraft 10 different handling characteristics, depending upon the turning direction.

It is contemplated that the structure of port and starboard side adjustable sponsons 12 will be identical, apart from the sponson bodies being mirror images of each other. The description herein of one adjustable sponson therefore will be understood as applying equally to both, unless specified to the contrary.

Figure 3:
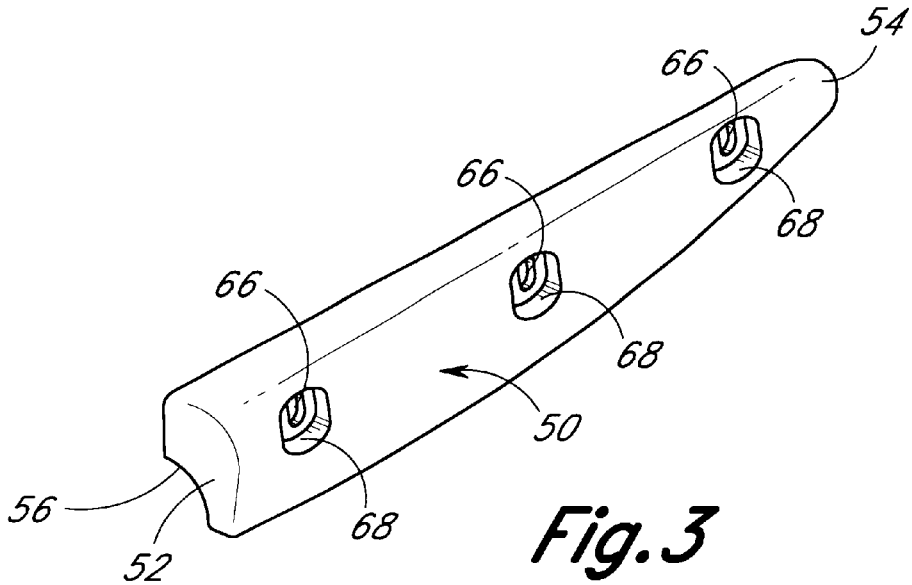
FIG. 3 is a rear perspective view of a starboard side sponson body of the adjustable sponson illustrated in FIG. 1.
Figure 4:
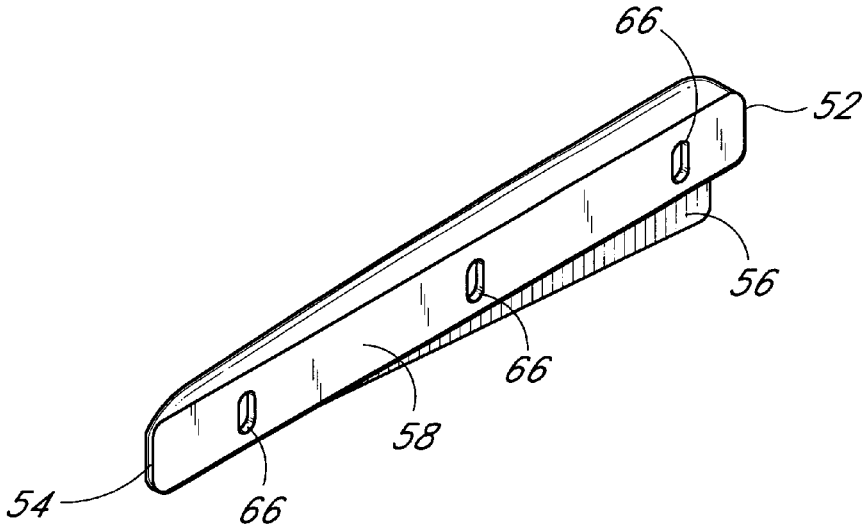
FIG. 4 is a front perspective view of the sponson body of FIG. 3.
Figure 5A:
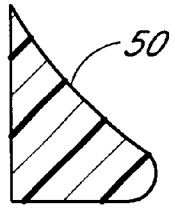
FIGS. 5*a*–5*d* are cross-sectional views of exemplary cross-sectional shapes of additional embodiments of the sponson body.
Figure 5B:
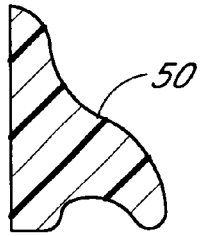
Figure 5C:
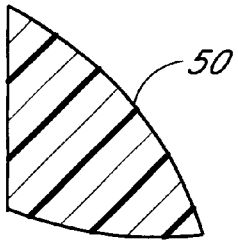
Figure 5D:
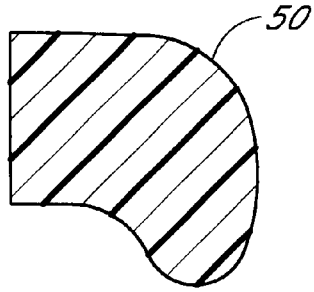

FIGS. 3 and 4 illustrate an exemplary sponson body 50 which can be used with the present adjustable sponson 12. The body 50 has an elongated rib-like shape of a length substantially shorter than the length of the hull 14. In the illustrated embodiment, the sponson body 50 has a length roughly equal to about one-fourth the length equal to the watercraft 10; however, for heavier watercrafts or for watercrafts designed to accommodate multiple passengers, longer sponson bodies can be used.

The shape of the sponson body 50 tapers from its aft end 52 to a generally blunt nose 54 positioned at the fore end to give the body a substantially streamline shape in the direction of water flow over the sponson 12. That is, as best understood from FIG. 1, the lateral width of the sponson body 50 increases from its blunt nose 54 to its aft end 52.

As best seen in FIG. 3, an outer portion at the aft end 52 of the sponson body protrudes downward to give the sponson body 50 a generally fin-like shape. The sponson body 50 also includes an arcuate lower surface 56 formed on the underside of the sponson body 50. The arcuate lower surface 56 extends away from the side 46 of the hull lower section 16.

The outer portion of the sponson body 50 also tapers in thickness in the vertical direction such that the outer portion smoothly transitions into the blunt nose 54 of the sponson body 50 in the forward direction. That is, the degree to which the sponson body 50 protrudes downward decreases gradually and blends smoothly into the fore end. The fore end of the sponson body 50 does not protrude downwardly.

The size and shape of the sponson body 50 desirably is selected according to the preference of the particular rider and the number of riders. It is contemplated that other shapes and sizes of sponson body can be used with the present adjustable sponson 12. FIGS. 5*a*–5*d* illustrate several other cross-sectional shapes which the sponson body 50 can take. For more aggressive turning characteristics and responsiveness, a rider can use a sponson body that has a cross-sectional shape of the type illustrated in FIG. 5*b* or FIG. 5*d*. For more stability and maximum speed, especially with multiple riders, the personal watercraft can be fit with a sponson body 50 having a cross-sectional shape of the type illustrated in FIG. 5*a* or FIG. 5*c*. The size and degree of downward protrusion of the sponson body 50 also can be selected to suit a particular size and riding style of the rider. With the foregoing in mind, those skilled in the art will appreciate that sponson body 50 can take a variety of different sizes and shapes, in addition to those exemplary shapes illustrated herein, in order to suit a specific application, riding condition, or watercraft loading.

As best seen in FIG. 4, the sponson body 50 includes a generally flat inner mounting surface 58. The mounting surface 58 abuts the side 46 of the lower hull section 16 when assembled, as illustrated in FIG. 7 and described below.

In addition to the sponson body 50, the adjustable sponson 12 also includes a coupling mechanism. The coupling mechanism releasably couples the sponson body 50 to the lower hull section 16 and allows for adjustment of the vertical position and the angular orientation of the sponson body 50 relative to the corresponding outer chine 48 of the hull lower section 16. In the illustrated embodiment, the coupling mechanism includes a guide mechanism 60 and a locking mechanism 62.

Figure 6:
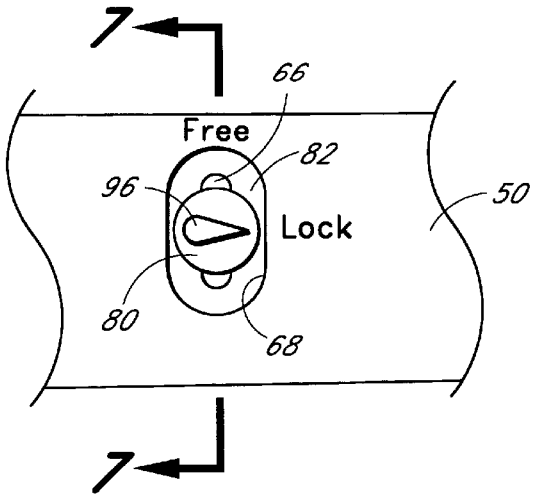
FIG. 6 is an enlarged side perspective view of a coupling mechanism of the adjustable sponson of FIG. 1.
Figure 7:
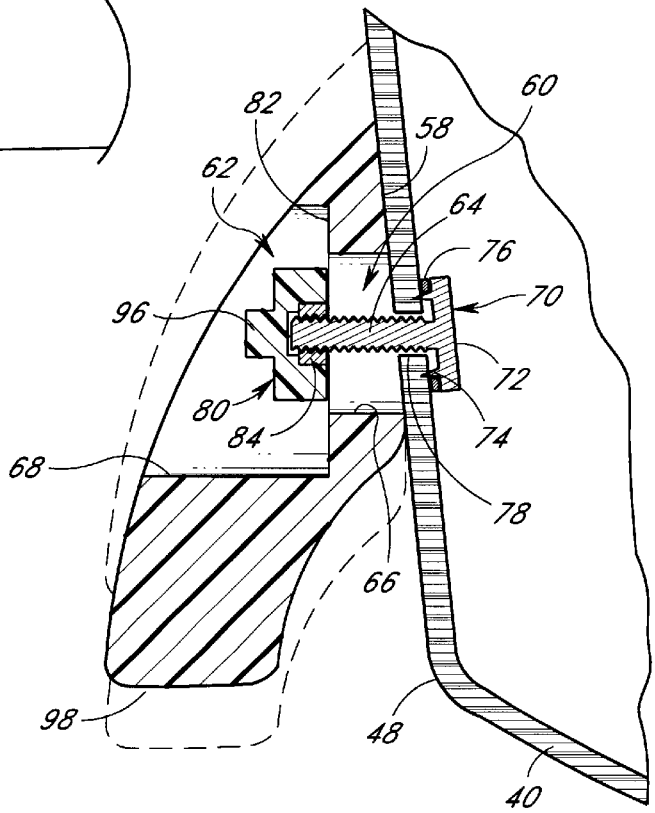
FIG. 7 is a cross-sectional view of the coupling mechanism of FIG. 6 taken along line 7—7.

FIGS. 6 and 7 best show an illustrative embodiment of the guide mechanism 60 and the locking mechanism 62. In the illustrated embodiment, the guide mechanism 60 includes a plurality of studs 64 which cooperate with a plurality of inner slots 66 formed in the sponson body 50. The inner slots 66 extend into the sponson body 50 from the inner mounting surface 58. Each inner slot 66 opens into a larger aperture 68. As best seen in FIG. 6, the larger aperture 68 extends into the sponson body 50 from an outer side, and desirably has an obround shape which is concentrically positioned about the inner slot 66.

As seen in FIG. 7, each stud 64 projects outwardly from the side wall 46 of the lower hull section 16. The studs 64 extend generally normal to the surface of the side wall 46. As understood from FIG. 7, the studs 64 desirably form a portion of a fitting 70 which is attached to the lower hull section 16.

The fitting 70 includes a base 72 from which the stud 64 extends. The base 72 includes a plurality of spikes 74 which also project from the base 72. The spikes 74 extend into a side wall 46 of the lower hull section 16 when assembled. In this manner, the spikes 74 secure the base 72 to the lower hull section 14 and prevent the stud 64 from rotating.

The stud 64 desirably extends through an elastic washer or grommet 76 which lies between the base 72 and the inner side of the side wall 46. The stud 64 passes through a hole 78 in the side wall 46 to project outwardly form the side surface. The diameter of the hole 78 desirably matches that of the stud 64 such that the stud 64 substantially plugs the hole 78 when inserted through the hole 78. The tight fit between the hole 78 and the stud 64, coupled with the compression of the elastic washer 76 between the base 72 and the side wall 46, substantially seals the hole 78 to prevent significant ingress of water into the rear compartment 34 through the hole 78.

As best illustrated in FIG. 7, each stud 64 is positioned above the corresponding outer chine 48. In the illustrated embodiment, the stud 64 lies about 1.0 inch to about 3.0 inches above the outer chine 48. Of course, other locations of the stud 64 relative to the chine 48 are possible in order to accommodate the particular sizes of sponson body 50 used with the guide mechanism 60, as well as to suit the particular size and shape of the watercraft.

The studs 64 extend through the inner slots 66 of the sponson body 50 when assembled. Each stud 64 desirably has a diameter smaller than the width of the slot 66, and substantially smaller than the length of the slot 66. In the illustrated embodiment, the diameter of the stud 64 is about five times smaller than the length of the slot 66. As schematically illustrated in FIG. 6, this difference in slot length to stud diameter allows the vertical position of the sponson body 50 on the hull side wall 46 to be adjusted. The longer the slot 66 relative to the stud diameter size, the greater the degree of adjustability of sponson position in the vertical direction. The relative sizes between the stud diameter and the slot length of course can readily be customized to suit specific applications. The clearance between the slot 66 and the stud 64 afforded by the wider slot 66 also permits the sponson body 50 to be set in an angled orientation relative to the chine 48, as described below.

Although the illustrated embodiment of the guide mechanism 60 has been described as including individual fittings 70, it is contemplated that a common bar can support the studs 64. In this embodiment, the bar either attaches to or is integrally molded into the lower hull section 16. The bar extends generally parallel to the corresponding outer chine 48 of the lower hull section 16. The studs 64 extend through the hull side wall 46 substantially in the same position as illustrated in FIG. 7.

With reference back to FIGS. 6 and 7, the locking mechanism 62 of the illustrated embodiment desirably includes releasable couplers 80 which cooperate with the studs 64 of the guide mechanism 60. Each coupler 80 has a diameter larger than the width of the slot 66, but smaller than the width of the outer aperture 68. In this manner, as understood from FIGS. 6 and 7, the coupler 80 sits within the outer aperture 68 and abuts an inner surface 82 of the aperture 68 on either side of the slot 66. When engaged with the stud 64, the coupler 80 tightly forces the sponson body 50 against the side wall 46 of the lower hull section 16, as described below.

In the illustrated embodiment, the coupler 80 includes an internal nut 84 which cooperates with an outer end of the corresponding stud 64. For this purpose, the outer end of each stud 64 supports an external thread which engages an internal thread carried by the corresponding nut 84.

The thread pitch, pitch diameter, and the number of engaged thread pitches of the threads, advantageously are selected to produce high axial compression between the coupler 80, the sponson body 50 and the hull side wall 46, without structural failure and with minimum rotation. It is also desirably to select a generally standard thread for manufacturing convenience. For instance, in an exemplary embodiment, the nut 84 and the stud 64 comprise a series of 1/4-28 UNF threads with at least several threads engaging when the nut 84 is threaded onto the stud 64. Several rotations of the coupler 80 about the stud 64 tightly compresses the sponson body 50 against the side wall 46 and secures the coupler 80 in place. Of course, the threads can have other sizes in order to produce the desired axial compression with minimum rotation.

The stud 64 and the internal nut 82 desirably are formed of a durable, strong, corrosion-resistant material, such as, for example, stainless steel. The threads of the stud 64 and the inner nut 82 must be sufficiently strong in order to take the loading required to set and secure the sponson body 50 onto the hull side wall 46, and be durable to withstand numerous threadings.

Figure 8:
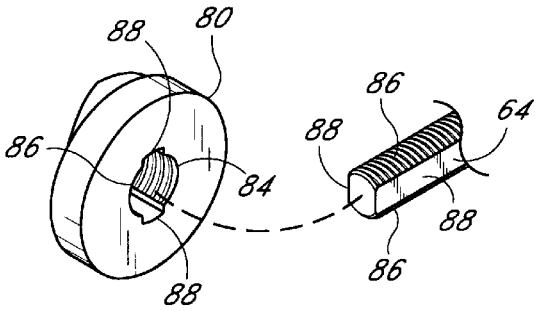
FIG. 8 is an exploded, partial side perspective view of a quick connect/disconnect mechanism of a quick-release locking device of the adjustable sponson.

The locking device 62 can also include a quick-connect/disconnect mechanism between the coupler 80 and the stud 64. For instance, as illustrated in FIG. 8, the coupler 80 and the stud 64 can include axially extending splines 86 spaced apart by axially extending flats 88. That is, both the stud 64 and the nut 84 include interrupted threaded sections. The splines 86 and flats 88, which are alternatively disposed on the interior circumference of the nut 84, provide an axial key-way for receiving the corresponding axial splines 86 formed on the stud 64. The coupler 80 is placed over the stud 64 with the nut 84 freely receiving the end of the stud 64, and is rotated to interlock the corresponding splines 86 on the nut 84 and the stud 64. It is desired that minimum rotation of the coupler 80 relative to the stud 64 (e.g., 90 degrees) will produce sufficient axial compression between the coupler 80, sponson body 50 and lower hull side wall 46 to set and secure the sponson body 50 to the lower hull section 16.

Figure 9:
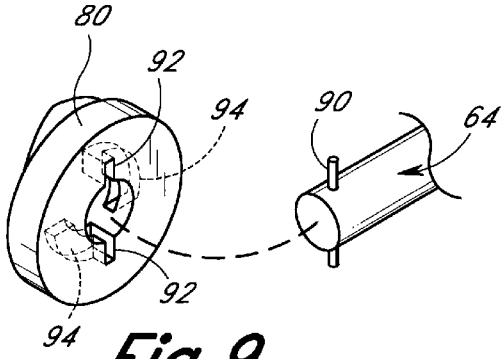
FIG. 9 is an exploded, partial side view perspective of a quick-connect/disconnect mechanism of another quick-release locking device.

Of course, other types of quick-connect/disconnect mechanisms can be employed between the stud 64 and the coupler 80. For instance, as seen in FIG. 9, the stud 64 can include retainer pin 90 which extends through the stud 64 in a direction generally perpendicular to the axis of the stud 64. The coupler 80 can include diametrically opposed internal axial grooves 92 and diametrically opposed internal transverse grooves 94. Each axial groove 92 intersects with one of the transverse grooves 94. The transverse grooves 94 are obliquely positioned relative to the axis of the corresponding stud 64 and extend toward and outer end of the coupler 80. The coupler 80 is attached to the stud 64 by fully inserting the protruding ends of the retainer pin 90 into the corresponding axial grooves 92 and then rotating the coupler 80 to move retainer pin ends into the transverse grooves 94. The skewed orientation of the transverse grooves 94 forces the coupler 64 against the sponson body 50 as the pin ends are rotated further into the transverse grooves 94. The transverse grooves 94 desirably are orientated so as to produced the desired compression between the coupler 80 and the sponson body 50 with minimum rotation (e.g., 90 degrees).

As best seen in FIG. 6, the coupler 80 desirably includes an elongated knob 96 that extends across the diameter of the coupler body. The knob 96 acts as a handle, which allows the operator to grasp the coupler 80 in order to rotate and to tighten the coupler 80 onto the stud 64.

In the illustrated embodiment, the elongated knob 96 has an arrow-like shape with a generally pointed end. The sponson body 50 can also include indicia to indicate when the knob 96 is in a position securing the sponson body 50 to the hull side wall 46; i.e., when the handle is in a "locked position." Additional indicia on the sponson body 50 can be included to indicate when the knob 96 is in a position which allows the sponson body 50 to be moved relative to the studs 64. In the illustrated embodiment, the term "free" is disposed at a location 90 degrees away from the locked position where the coupler 80 is sufficiently loosened with 90-degrees rotation to allow the sponson body 50 to be adjusted. Of course, other indicia positioned at other locations is also possible.

Figure 10A:
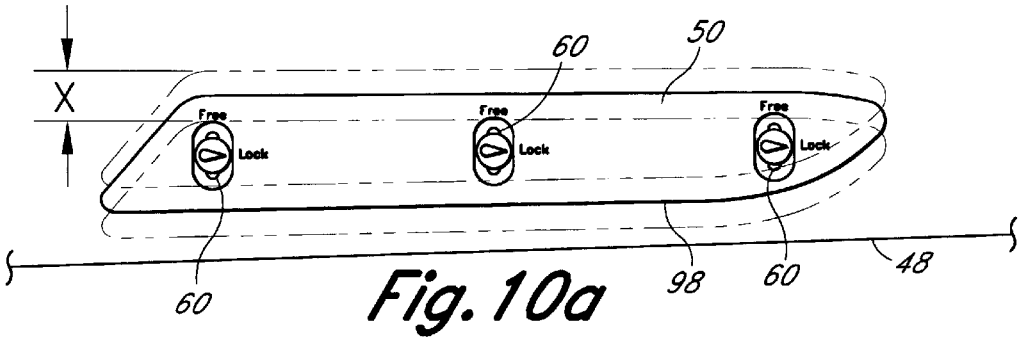
FIGS. 10*a*–10*d* are side elevational views of the adjustable sponson of FIG. 1, schematically illustrating various positions and angular orientations of the sponson relative to an outer hull chine of the watercraft.
Figure 10B:
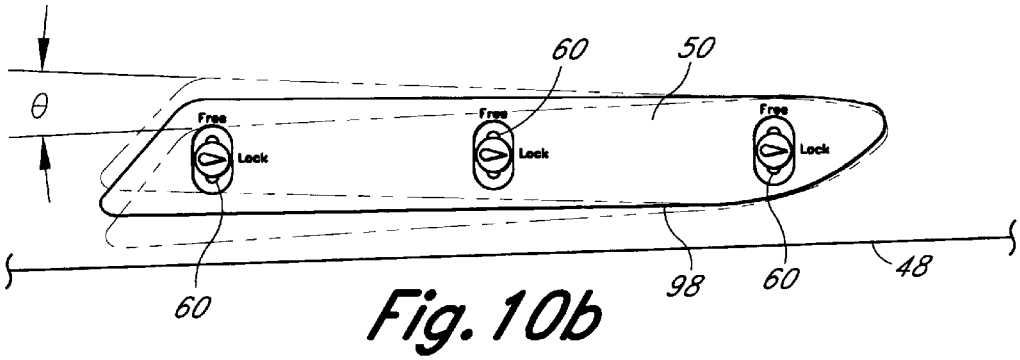
Figure 10C:
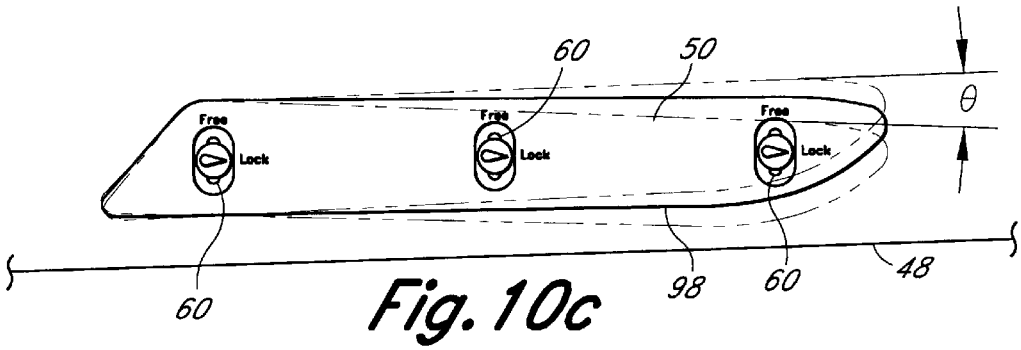
Figure 10D:
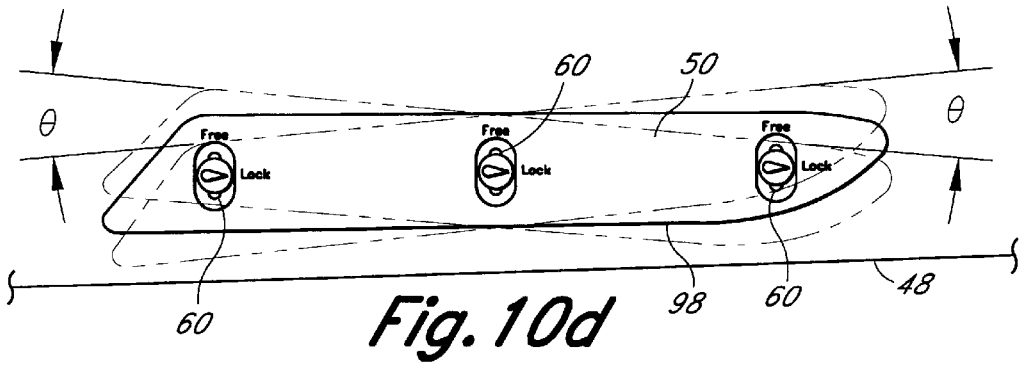

With reference to FIGS. 1 and 10*a*, the adjustable sponson 12 desirably includes three locking mechanisms 62 to secure the sponson body 50 to the personal watercraft 10: one positioned at the fore end of the sponson body 50; a second positioned at the aft end 52 of the sponson body 50; and a third located in the middle of the sponson body 50. As illustrated in FIGS. 10*a*–10*d*, the resulting positions of the studs 64 of the guide mechanisms 60 allow the vertical position of the sponson body 50 on the hull side 46 to be adjusted, as well as the angular orientation of the sponson body 50 to be adjusted. For instance, FIG. 10*a* illustrates that the sponson body 50 can be positioned at an infinite number of vertical positions relative to a horizontal within a given range X defined by the length of the slots 66. As seen in FIG. 10*b*, the aft end 52 of the sponson body 50 can also be raised or lowered through angle θ, with the sponson body 50 pivoting about the fore stud 64, to give the sponson 12 a positive angular orientation (i.e., the fore end positioned above the aft end) or a negative angular orientation (i.e., the aft end positioned above the fore end). Likewise, as seen in FIG. 10*c*, the fore end of the sponson body 50 can be raised or lowered through angle θ, with the sponson body 50 pivoting about the aft stud 64, to give the sponson 12 a positive or negative angular orientation relative to the horizontal. And as seen in FIG. 10*d*, both the fore and aft end can simultaneously be lowered and raised or raised and lowered through angle θ causing the sponson body 50 to pivot about the middle stud 64. The present guide mechanism 60 thus allows the ends of the sponson body 50 to be moved independent of each other. The guide mechanism 50 also affords the possibility of positioning and orientating the sponson body 12 in any of a wide variety of vertical positions and angular orientations relative to the chine 48.

The installation of the adjustable sponsons 12 on either side of the watercraft hull is substantially identical. The following description therefore will be understood as applying equally to both the starboard and port side adjustable sponsons 12, unless specified to the contrary.

To attach the sponson body 50 to the personal watercraft 10, the sponson body 50 is aligned with the studs 64 which project outwardly from the side walls 46 of the watercraft lower hull 16. The aft end 52 of the sponson body 50 lies proximate to the stern of the watercraft 10, while the fore end extends toward the bow of the watercraft 10. The rider then slides the sponson body 50 onto the studs 64 to a position where the flat inner mounting surface 58 of the sponson body 50 abuts the side wall 46 of the watercraft lower hull portion 16.

The rider then sets the position of a lower edge 98 of the sponson body 50 relative to an imaginary incident line I. As seen in FIG. 2, the incident line I extends from the outer chine 48 at an angle which corresponds to the angular orientation of the corresponding angular hull surface 40 of the lower hull section 16. The incident line I represents the water line when the watercraft 10 is leaned onto the angular hull surface 40. The vertical position of the lower edge 98 of the sponson body 50 relative to the incident line I affects the handling characteristics of the watercraft 10, as described below.

The rider moves the sponson body 50 up or down with the studs riding in the inner slot of the sponson body 50. In this manner, the interaction between the studs 64 and the slots 66 guides the sponson body 50 over the hull side within a given range of vertical adjustability. The length of the inner slots generally establish this range X of vertical movement of the sponson body 50 relative to the stud 64.

The rider also sets the angular orientation of the sponson body 50 relative to the outer chine 48 of the lower hull section 16. As noted above, the rider can set the angular orientation of the sponson body 50 at either a positive or a negative slope, depending upon the riding conditions and the desired ride.

The rider secures the sponson body 50 to the hull side 46 with the locking device 62. In the illustrated embodiment, the rider threads one of the couplers 80 onto the end of each stud 64 and tightens the couplers 80 onto the studs 64 by hand. The rider easily grasps and rotates the coupler by its elongated knob 96. In this manner, the rider secures the coupler 80 to the stud 64 without the aid of tools.

Where the locking device 62 includes a quick-connect/disconnect mechanism (such as the type illustrated in FIGS. 8 or 9), the rider desirably rotates the coupler 80 through about 90 degrees to secure the coupler 80 to the stud 64. Again, the rider can grasp and rotate the coupler 80 by its elongated knob 96. To release the coupler 80 from the stud 64, the coupler 80 is rotated in the opposite direction through the same degree of rotation and slide off the end of the stud 64.

The locking mechanism 62 forces the inner surface 58 of the sponson body 50 tightly against the hull surface 46 with the couplers 80 fully engaging the studs 64 (i.e., turned to the locked position). The resultant frictional force desirably is sufficient to withstand the vertical and horizontal loadings placed on the sponson body 50 during use of the personal watercraft 10.

Figure 11:
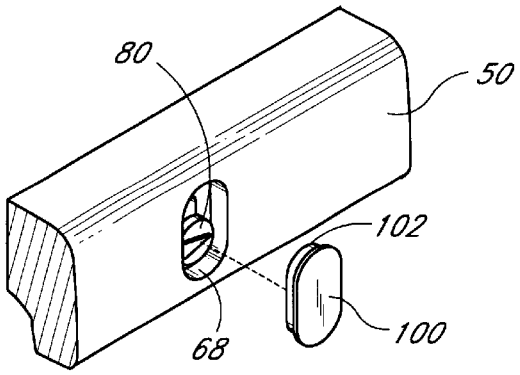
FIG. 11 is an enlarged, exploded, partial side perspective view of the adjustable sponson with an aperture cover.

With reference to FIG. 11, the rider can also place a cover 100 over each outer aperture 68 of the sponson body 50 to enclose the coupler 80 and stud 64 (not shown) within the sponson body 50. The covers loo include a flange 102 or similar tabs which cooperate with the sides of the outer aperture 68 to releasably secure the cover 100 onto the sponson body 50. The covers 100 can be snapped off the sponson body 50 by a coin, key, flat-head screw driver, or similar article to expose the releasable coupler 80.

Figure 12:
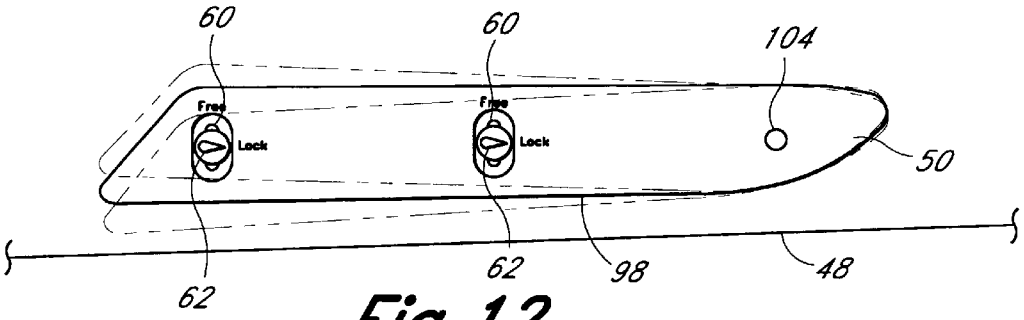
FIG. 12 is a side elevational view of an adjustable sponson configured in accordance with another preferred embodiment of the present invention.

As is apparent from the above description, the guide mechanism 60 of the present adjustable sponson 12 allows both the vertical position and the angular orientation of the sponson body 50 to be adjusted. It is contemplated, however, that the present adjustable sponson 12 can include a guide mechanism which allows fewer or greater degrees of freedom. For instance, as seen in FIG. 12, the guide mechanism can include an end coupling 104 which fixes the vertical position of one end of the sponson body 50, but allows the opposite end to be moved to rotate the sponson body 50 about the end coupling 104. The guide mechanism can also include at least one, and preferably two pin/slot mechanisms and related locking devices of the types described above.

The ability to easily and readily change the position and the angular orientation of the sponsons 12 on the watercraft 10 allows the rider to tailor the stability and responsiveness of the watercraft 10 to his or her style. For instance, a higher mounted sponson 12 (i.e., a sponson 12 with the lower edge 98 lying above the incident line I) gives a more forgiving ride with lessened tendency of the watercraft 10 to dig into the water at high speeds. At planing speeds, the lower surface 56 and outer edge 98 of the sponsons 12 normally ride above of the water when traveling straight. The size of the hull 14 in the water is minimized, thereby reducing drag on the personal watercraft 10 and improving top speed. When the rider turns the personal watercraft 10 at elevated speeds, the rider must substantially lean the watercraft 10 on its side before the sponson 12 contacts and cuts (i.e., hooks) into the water. The hull 12 leans or keels over and the sponson 12 on the side of the direction of turn contacts the water. The lower surface 56 of the sponson 12 effectively widens the hull (i.e., creates a greater hull surface) to give the personal watercraft 10 greater stability and to counteract the rider's shifted body weight when turning. As a result, the sponson 12 affords additional stability as the watercraft 10 leans to one side during turns. Of course, the degree to which changes in the vertical position of the sponson 12 affect the stability and handling characteristics of the watercraft 10 will vary with the size and shape of the watercraft 10.

A lower mounted sponson 12 will give the personal watercraft 10 more aggressive turning characteristics and responsiveness. That is, if the sponson 12 lies well below the incident line I, a substantial portion of the sponson 12 will cut into the water with minimal lean by the rider. The watercraft 10 tends to pivot about or ride on the relatively short sponson 12 with the sponson 12 effectively acting as an additional outer chine, channeling the water. The lower the sponson 12 in relation to the outer chine 48, the tighter the watercraft 10 will turn. In other words, the more the lower edge 98 of the sponson body 50 protrudes below the incident line I, the more aggressive the handling characteristics of the watercraft 10 become and the tighter the turning radius of the watercraft 10.

It also is desirable to adjust the angular orientation of the sponson 12 to suit riding conditions and to optimize speed and ride comfort. As noted above, the angle of the sponson 12 relative to the outer chine 48 affects the stability and handling characteristics of the watercraft 10. A pronounced positive angle (i.e., the fore end positioned above the aft end) forces the bow of the personal watercraft 10 against the water and maximizes speed. Too large of an angle, however, can tend to force the bow down too far and substantially dig into wakes and chops in the water, producing an unpleasant ride. The optimum angle varies depending upon the rider's size (i.e., the loading on the personal watercraft 10) and the water conditions.

Some riders prefer a slightly negative angular orientation of the sponsons 12 (i.e., the aft end positioned above the fore end). The slight negative angle of the sponsons 12 help keeps the bow of the watercraft 10 up when the watercraft 10 is on plane. This provides a more stable and comfortable ride, while sacrificing speed.

The ability to change the angular orientation of the sponsons 12 thus allows each rider to change the riding characteristics of the watercraft 10. The positive angular orientation of the sponson 12 can easily be adjusted to optimize top-end performance of the watercraft 10 for the particular size of the rider. The sponsons 12 also can readily be set in a slightly negative angular orientation to improve the ride of the watercraft 10 when up on plane, which may be desired for less aggressive riders or during rough water conditions.

The present adjustable sponson 12 system also allows for different styles or sizes of sponson bodies 50 to be interchanged on the same personal watercraft 10. For instance, larger sponson bodies 50 are particularly useful when the watercraft 10 is carrying numerous passengers because the passengers increase the loading on the watercraft 10. In a fully loaded condition, the watercraft 10 tends to lean more during sharp maneuvers. Larger sponsons 12 provide increased stability because the increased hull surface helps compensate and support the additional weight. Larger sponsons 12 also provide added buoyancy which is helpful when a rider is attempting to climb onto the watercraft 10. The increased buoyancy is particularly desirably for less-experienced riders.

As noted above, different sponson styles also produce different riding characteristics. Accordingly, the ability to easily and quickly remove the sponson body 50 without the aid of tools allows each rider to select the preferred and appropriate sponson shape and size for the particular riding style of the rider or riders, for the particular loading condition on the watercraft and for the particular water condition at that time.

Although this invention has been described in terms of certain preferred embodiments, other embodiments apparent to those of ordinary skill in the art are also within the scope of this invention. For instance, it is contemplated that the adjustable sponson can include an inner mounting edge which permanently attaches to the watercraft hull and an outer edge portion which is adjustable relative to the inner mounting edge (rather than relative to the hull) in the manner described above. Accordingly, the scope of the invention is intended to be defined only by the claims which follow.

What is claimed is:

1. An adjustable sponson for use with a watercraft hull, said adjustable sponson comprising an elongated sponson body, a guide mechanism operable between at least a portion of said sponson body and the watercraft hull, said guide mechanism defining a translational travel path for the entire sponson body over an outer surface of the watercraft hull, and a locking device adapted to establish a set position of said portion of said sponson body along said travel path.

2. An adjustable sponson as in claim 1, wherein said guide mechanism comprises at least one stud connected to the watercraft hull and at least one slot formed in said sponson body, said stud lying within said slot.

3. An adjustable sponson as in claim 2, wherein said slot extends in a direction which is generally normal to a longitudinal axis of the sponson body.

4. An adjustable sponson as in claim 2, wherein said guide mechanism comprises a plurality of studs and corresponding slots with said stud and slot pairings being spaced apart from one another along a length of said sponson body.

5. An adjustable sponson as in claim 4, wherein said guide mechanism includes at least one stud and slot pairing positioned at each longitudinal end of said sponson body, and at least one stud and slot pairing position at about a longitudinal mid point of said sponson body.

6. An adjustable sponson as in claim 2, wherein a length of said slot is at least twice that of a diameter of said stud.

7. An adjustable sponson as in claim 2, wherein said locking device comprises a coupler which engages an end of said stud which projects through said sponson body with said stud lying within said slot.

8. An adjustable sponson as in claim 7, wherein said coupler and said stud end include corresponding threads.

9. An adjustable sponson as in claim 7, wherein said locking device includes a quick-connect/disconnect mechanism cooperating between said coupler and said end of said stud.

10. An adjustable sponson as in claim 1, wherein said guide mechanism comprises means for establishing a range of linear movement of said sponson body relative to a chine of the watercraft hull between a first position and a second position.

11. An adjustable sponson as in claim 10, wherein said locking device comprises means for selectively establishing a set position of said sponson body with respect to the chine of the watercraft hull at any point between said first and second positions.

12. An adjustable sponson as in claim 10, wherein said guide mechanism comprises means for establishing angular movement of said sponson relative to the chine of the watercraft.

13. A watercraft as in claim 10, wherein the first position defines a lowest position of the sponson body and the second position defines a highest position of the sponson body on the watercraft hull, and at least a portion of the sponson body is positioned lower than an incident line, which extends from the chine at an angle which corresponds to an angular orientation of a lower hull surface adjacent the chine, with the sponson body positioned in the first position.

14. A watercraft as in claim 13, wherein at least a portion of the sponson body is positioned lower than the incident line with the sponson body positioned in the second position.

15. An adjustable sponson as in claim 1, wherein said locking device includes a quick-disconnect mechanism.

16. An adjustable sponson as in claim 1, wherein said guide mechanism is configured to allow at least one longitudinal end of said sponson body to move independent of the opposite longitudinal end.

17. An adjustable sponson as in claim 16, wherein he guide mechanism is configured to fix at least one of said longitudinal ends at a set point relative to the chine of the watercraft hull.

18. An adjustable sponson as in claim 16, wherein said guide mechanism is configured to permit both longitudinal ends of said sponson body to move relative to the chine of the watercraft hull and independent of each other.

19. An adjustable sponson for attachment to a hull of a watercraft, said adjustable sponson comprising a sponson body having an elongated, rib-like shape, means for allowing translational and rotational adjustment of the position of said sponson body on the hull surface of the watercraft, and means for setting the position of said sponson body on said hull.

20. An adjustable sponson as in claim 19, wherein said means for adjusting the position of the sponson body provides said sponson body with at least two degrees of freedom relative to the watercraft hull surface.

21. An adjustable sponson as in claim 19, wherein said means for setting the position of said sponson body is releasably connected to the watercraft hull.

22. An adjustable sponson as in claim 21, wherein said means for setting the position of said sponson body includes a quick-connect/disconnect mechanism.

23. A watercraft comprising a hull and at least one sponson attached to the hull by a coupling mechanism, the coupling mechanism securing the sponson to the hull in at least an upper position and in a lower position relative to a chine of the watercraft hull, the coupling mechanism operating between the sponson and the watercraft hull at a point above the chine, at least a portion of the sponson lying below an incident line, which extends from the chine at an angle which corresponds to an angular orientation of a lower hull surface adjacent the outer chine, when secured to the hull by the coupling mechanism in the lower position.

24. A watercraft as in claim 23, wherein at least a portion of the sponson lies below the incident line with the sponson secured to the hull by the coupling mechanism in the upper position.

* * * * *